US007945975B2

(12) United States Patent
Thomas et al.

(10) Patent No.: US 7,945,975 B2
(45) Date of Patent: May 24, 2011

(54) PATIENT ASSISTANCE DEVICE

(75) Inventors: John A. Thomas, Dallas, TX (US); Phillip A. Clifford, Dallas, TX (US)

(73) Assignee: SDS Medical Supply LLC, Frisco, TX (US)

( * ) Notice: Subject to any disclaimer, the term of this patent is extended or adjusted under 35 U.S.C. 154(b) by 23 days.

(21) Appl. No.: 12/473,068

(22) Filed: May 27, 2009

(65) Prior Publication Data

US 2010/0299830 A1 Dec. 2, 2010

(51) Int. Cl.
*A61G 1/00* (2006.01)
*A41D 1/04* (2006.01)

(52) U.S. Cl. ..... 5/81.1 T; 5/81.1 R; 5/89.1; 2/102; 2/69; 182/3; 297/484

(58) Field of Classification Search ..... 5/81.1 T, 5/81.1 R, 89.1; 2/69, 102, 94, 2.5
See application file for complete search history.

(56) References Cited

U.S. PATENT DOCUMENTS 4,453,271 A * 6/1984 Donzis ..... 2/2.5
4,739,526 A 4/1988 Hollick
5,267,948 A 12/1993 Elliott
5,397,171 A * 3/1995 Leach ..... 297/484
5,619,751 A * 4/1997 Ray et al. ..... 2/102
5,647,378 A 7/1997 Farnum
6,122,778 A 9/2000 Cohen
6,185,738 B1 2/2001 Sidebottom
6,196,229 B1 3/2001 Piazza
6,276,006 B1 8/2001 Hoit
6,837,832 B2 1/2005 Hanners et al.
7,360,543 B1 4/2008 Coleman et al.
2007/0105471 A1 * 5/2007 Wang et al. ..... 442/301
2008/0072629 A1 * 3/2008 Gehring ..... 66/202
2009/0320188 A1 * 12/2009 Johnson et al. ..... 2/69

OTHER PUBLICATIONS

How Antimicrobial Treatment Can Improve Nonwovens; http://www.aegisasia.com/Antimicrobial-Treatment-Improve.html.

* cited by examiner

*Primary Examiner* — Robert G Santos
*Assistant Examiner* — Brittany M Wilson
(74) *Attorney, Agent, or Firm* — David W. Carstens; Jeffrey G. Degenfelder; Carstens & Cahoon, LLP

(57) ABSTRACT

An improved device for assisting a caregiver in lifting and moving a patient. The device comprises a unitary garment member having a front panel section, a rear panel section and an interconnecting central or middle panel section. The device further includes a plurality of integral, reinforced support straps that enhance the structural integrity of the garment member. The rear panel section includes two flap portions extending laterally on opposing sides of the rear panel section. The two flap portions can be pulled forward and attached to the front panel section whereby the device becomes a vest-type garment that completely surrounds the patient's torso. The improved patient assistance device includes a plurality of strategically positioned hand holds, which provide enhanced leverage enabling a caregiver to more easily assist a patient wearing the device to move from one position to another.

20 Claims, 6 Drawing Sheets

PATIENT ASSISTANCE DEVICE

BACKGROUND OF THE INVENTION

1. Technical Field of the Invention

The present invention relates to an apparatus for assisting a caregiver in the lifting and/or positioning of a disabled person or patient. In particular, the present invention relates to an apparatus for assisting both the caregiver, as well as a person/patient who can partially bear weight, yet needs assistance with transferring and/or repositioning.

2. Description of the Related Art

A variety of proposals have previously been made to provide some type of patient lifting or transfer devices that enables a caregiver to safely assist a patient in moving from one position to another. By "patient" is meant any person irrespective of age, sex, health condition, physical impairment or disability that requires, even if only occasionally, assistance in moving or transferring. Such incapacitated individuals, whether short-term or long-term, oftentimes require assistance from another person when being moved, for example, into or out of beds, to and from a chair, to and from a toilet, car or sitting positions, even during physical therapy or the like. In particular, persons confined to wheelchairs, are often unable to stand on their own and require the assistance of one or more caregivers to move them from a wheelchair or other seating arrangement or to a standing position, or oftentimes to get into and out of a bath or shower chair.

Prior art lifting devices have previously employed mechanical lifts, which commonly have a sling for the patient to be raised and lowered, waist belts (commonly referred to as a "gait belt"), as well as hybrid non-mechanical lifts commonly referred to as "sit-to-stand" lifts for patients. In spite of a wide variety in the design of these lifting and transfer devices, each has its own inadequacies. For example, a variety of mechanical lifts, which include both manual, hydraulic and electrical devices, are known to be very bulky and hard to maneuver in small areas such as the bathroom, especially once the patient has been lifted and is in the sling. In the healthcare setting, like a nursing home or hospital, some of the most common drawbacks are 1) lack of training to caregivers/nurses to properly utilize the equipment, and 2) caregivers/nurses typically take several minutes to transfer a patient. It is, therefore, not surprising that caregivers oftentimes simply do a manual transfer rather than attempting to locate the transfer equipment. Indeed, manually lifting a patient/person is the most common type of transfer worldwide.

Similarly, the prior art waist or "gait" belt devices have also proven problematic. A gait belt is a padded belt that fits around the patient's lower rib area and usually comes with multiple handles that are used to grab the patient. Some of the commonly known drawbacks of gait belt devices include 1) they are uncomfortable for the patient, 2) they have a tendency to slide up or down during transfer, 3) they can contribute to a patient falling due to the fact that the upper torso of the patient is never stabilized during the transfer process, and 4) they can cause skin tears, bruising, as well as inappropriate touching to the patient. In addition, when a gait belt device is used to transfer a patient, the caregiver puts themselves at risk to potential injury (e.g., back and shoulder injuries), especially if this transfer position is repeated over and over.

While prior art sit-to-stand lifting/transfer devices are quicker than the traditional mechanical lift, they also exhibit several common drawbacks, including 1) they typically require the patient to be able to hold onto handles while the patient is lifted up, 2) they are also bulky and hard to push once the patient is in the device, and 3) they are also very difficult to get in and out of toilet and bathing areas.

Due to the previously mentioned inadequacies with each of these prior art transfer devices, the most common type of patient transfer is accomplished by means of manual transfer, wherein patients are assisted by a caregiver manually grasping the patient to assist him or her in moving from one position to another. Such manual grasping techniques are usually difficult and oftentimes dangerous to both the patient and the caregiver. Caregivers typically grasp the patient by their arms or their belt to assist in hoisting them from one position to another position (e.g., a wheelchair or a seated position). In other instances, to gain leverage caregivers grab articles of clothing such as a trouser seat or shirt collar, however, these garments are not designed or adapted for easy grasping, and sometimes tear, and require a strong grip on the part of the caregiver. This technique is not only uncomfortable for the patient, it can also cause bruising, skin tears, or even contribute to a patient falling and sustaining more serious injuries.

Further, because of the difficulty of grasping hold of a patient that needs to be moved from one position to another, a caregiver frequently sustains injuries to himself or herself such as an injured back. Injuries to caregivers are particularly likely due to the arching of the back in an unfavorable ergonomic position when attempting to assist a patient with transfer.

Certain patents and publications have disclosed concepts associated with assisting handicapped or incapacitated patients, but none meet the needs filled by the present invention. For example, U.S. Pat. No. 6,122,778 issued Sep. 26, 2000 to Cohen describes a loose-fitting vest or garment-like device which enables caregivers to assist a patient in moving from one position to another. Such vest is distinguishable from the present invention because it comprises a lifting harness loosely attached to a garment vest. The harness includes a waist and chest belts attached by two shoulder straps. The waist and chest belts are adjustable (which typically takes approximately 3-5 minutes to adjust to any one patient) and include a buckle for releasable attachment around the patient. The lifting harness includes multiple handholds for assisting a caregiver in grasping the patient. However, the garment vest is not part of the skeletal lifting structure of the device. Instead, the garment vest is essentially used to properly orient the lifting harness about the patient's body. Moreover, the configuration of the Cohen garment vest itself can be difficult for patients in a supine position or with limited arm and shoulder flexibility to put on or to remove. Moreover, the Cohen vest can also cause irritability underneath the armpits as the vest has a tendency to slip upwards during transfer. In addition, when the caregiver grabs the lifting straps to attempt a transfer, a lot of pressure is applied to the harness areas due to the fact the garment material is made of a light weight fabric, which does not provide padding for comfort, and can cause bruising, even broken ribs, especially when transferring the elderly person with osteoporosis. Lastly, the Cohen vest cannot be used by multiple patients in a healthcare setting without risking the spread of infectious diseases from one patient to another.

Similarly, U.S. Pat. No. 5,647,378 to Farnum discloses a lifting support belt constructed of an elastic, flexible rubber-like material and includes a plurality of flexible handles, which are fixed to the belt in a spaced apart relation. The Farnum design requires that the length of the belt be customized to fit different sized individuals. While useful in some situations, the handholds of the Farnum design do not provide adequate leverage to a caregiver in all situations. For example, the Farnum design does not include any means for grasping a patient's chest or shoulder area.

Thus, a continuing need exists for an improved transfer device that assists caregivers in lifting and moving patients in a wide variety of scenarios. Further, a need exists for an improved lifting assistance device that is easier to put on and take off. A need also exists for an improved lifting assistance device that is more easily adjustable to a wide variety of patients. In addition, it is oftentimes useful for a patient to keep a lifting garment on for an extended period of time or a wide variety of activities. For example, it would be useful for a patient to wear an improved lifting assistance device for an extended period, wherein the device is comfortable to wear and could be used to assist the patient out of his bed or wheelchair, position him on an MRI table, assist him to and from the toilet or assist him during physical therapy at a water aerobics class. Thus, a need also exists for an improved lifting assistance device, which is comfortable to wear in a wide variety of environmental scenarios, yet resistant to bacterial growth and odor so as to eliminate the spread of infectious diseases, bacterial growth or odor from one patient to another.

SUMMARY OF THE INVENTION

The present invention overcomes many of the disadvantages of prior art lifting assistance devices by providing an improved patient assistance device that is easy to put on and take off, very comfortable to wear and highly adjustable in a matter of seconds. The improved patient assistance device includes a plurality of strategically positioned hand holds, which provide enhanced leverage enabling a caregiver to more easily assist a patient wearing the device to move from one position to another.

The patient assistance device of the present invention comprises a poncho-style garment in the form of a unitary member having a front panel section, a rear panel section and a central or middle panel section interconnecting the front and rear panel sections. The unitary garment member is generally constructed of a flexible, durable material. In one embodiment, the material comprising the unitary garment member is bonded with an anti-microbial agent for added hygienic protection. In a preferred embodiment, the unitary garment member is constructed of a composite material comprised of a polyester-blend outer shell bonded to a multi-layer sheet of neoprene rubber. Neoprene was chosen from a comfort perspective to act as padding to the patient's body to protect against potential bruising, skin tears, as well as broken bones, especially to the rib area for the frail elderly with osteoporosis. While in the preferred embodiment the front, central and rear panel sections of the unitary member are constructed from a single, homogenous piece of material, in other embodiments each panel section may be constructed separately of materials having different characteristics (e.g., buoyancy, strength, flexibility, etc.), then subsequently attached to the other panel sections.

The front panel section is sized and shaped to fit across the patient's chest area while the rear panel section is sized and shaped to fit across the patient's back. The central panel section includes an opening sized and shaped for receiving a human head therethrough. The rear panel section includes two flap portions extending laterally on opposing sides of the rear panel section. The inner-facing surface of the two flaps are covered with a layer of attachment fabric in the form of hook-and-loop type fastening members. A complementary layer of the attachment fabric covers a substantial portion of the outer-facing surface of the front panel section so that when the patient assistance device is properly configured on a patient, the two flap portions of the rear panel section can be pulled forward underneath the patient's arms and selectively attached to the outer-facing surface of the front panel section. Thus, when the two flap portions of the rear panel section are properly attached to the outer-facing surface of the front panel section, the patient assistance device effectively becomes a vest-type garment which completely surrounds the patient's torso.

The patient assistance device further includes a plurality of integral, reinforced support straps that are firmly attached to the unitary garment member. The plurality of support straps enhance the structural integrity of the unitary garment member by transferring and distributing a load applied to one support strap to the entire patient assistance device. The plurality of support straps include two laterally spaced shoulder support straps that are positioned over the patient's shoulders and extend the length of the unitary garment member. In addition, two back support straps are configured in a criss-cross or crossbuck arrangement across the rear panel section. The ends of the back support straps are attached to the two shoulder support straps, thereby enhancing the structural rigidity of the rear panel section. Similarly, the front panel section includes a lateral support strap that extends between the two shoulder support straps enhancing the structural rigidity of the front panel section. Finally, each flap portion of the rear panel section includes a support strap that is laterally spaced from its respective shoulder support strap.

The patient assistance device further includes more than one strategically positioned hand holds that are attached to the support straps. The hand holds provide enhanced leverage, which enables a caregiver to more easily assist a patient wearing the device to move from one position to another, while keeping the upper torso of the patient stabilized during the transfer process. In one embodiment, the hand holds comprise straps of reinforced webbing material attached to the support straps. In a preferred embodiment, the hand holds further comprise plastic handles attached to the straps.

The patient assistance device may further include one or more grommets, which improve the breathability of the garment member, further enhancing the comfort of the patient wearing the assistance device. In one embodiment, the rear panel section may include a plurality of grommet holes to provide additional breathability.

BRIEF DESCRIPTION OF THE DRAWINGS

A more complete understanding of the method and apparatus of the present invention may be had by reference to the following detailed description when taken in conjunction with the accompanying drawings, wherein.

Figure 1:
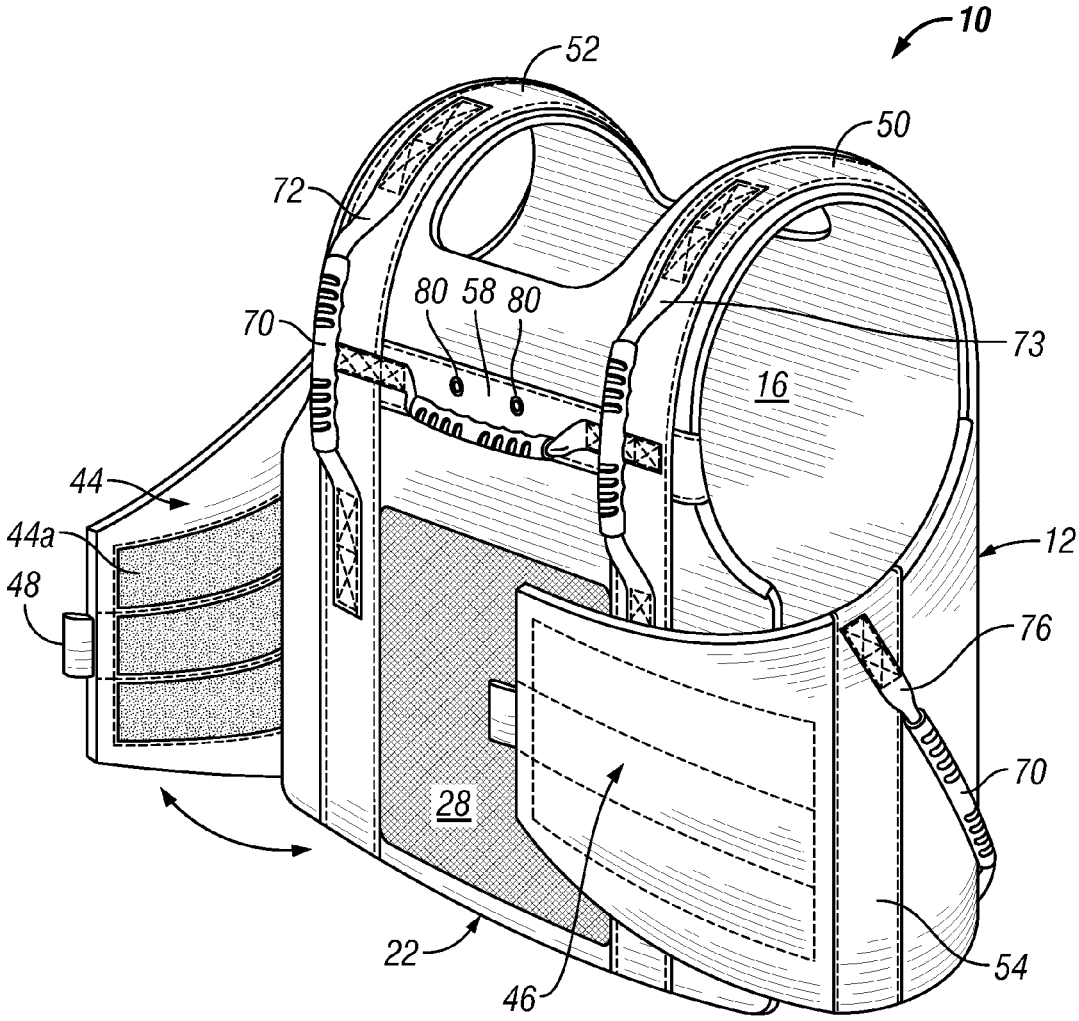
FIG. 1 is a front perspective view of the patient assistance device of the present invention.

Where used in the various figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

Figure 2:
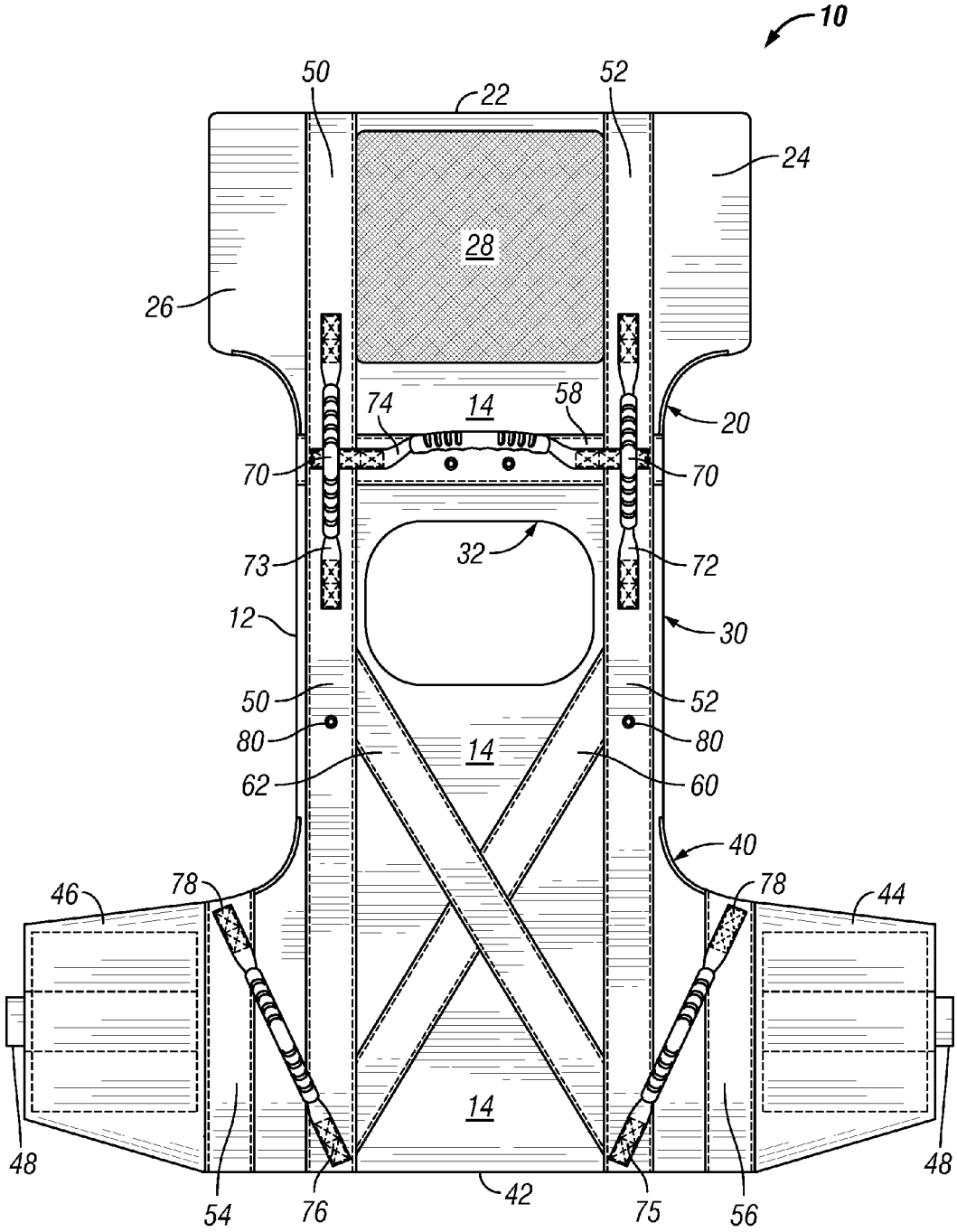
FIG. 2 is a top plan view of the device shown in FIG. 1 in a fully opened configuration.

With reference to the Figures, and in particular FIGS. 1 and 2, an embodiment of the patient assistance device 10 of the present invention is shown. The patient assistance device 10 comprises a reinforced poncho-vest garment worn by a patient. The device 10 assists caregivers in lifting and moving the patient in a wide variety of scenarios. The device 10 is designed to be easily donned and removed from a patient.

The patient assistance device 10 of the present invention comprises a poncho-style garment in the form of a unitary member 12 having a front panel section 20, a rear panel section 40 and a central or middle panel section 30 interconnecting the front and rear panel sections. The front panel section 20 is sized and shaped to fit across the patient's chest area while the rear panel section 40 is sized and shaped to fit across the patient's back. The central panel section 30 includes an opening 32 sized and shaped for receiving a patient's head therethrough. The front panel section 20 may further include wing portions 24, 26 that extend laterally from opposing sides of the front panel section 20.

The unitary garment member 12 is generally constructed of a flexible, durable material. For example, in one embodiment the material comprises a neoprene rubber material. Preferably, the material comprising the unitary garment member 12 is also bonded with an anti-microbial agent (e.g., AEM 5700) for added hygienic protection. In a one embodiment, the material comprises a polyester blend outer shell and multiple layers of neoprene rubber treated with an anti-microbial agent and bonded with adhesive under pressure. In a preferred embodiment, the neoprene layers are treated with a anti-microbial agent so as to form a covalent bond with the neoprene. While in the preferred embodiment the front 20, central 30 and rear 40 panel sections of the unitary member 12 are constructed from a single, homogenous sheet of composite material, in other embodiments each panel section may be constructed separately of materials having different characteristics (e.g., buoyancy, strength, flexibility, etc.), then subsequently attached to the other panel sections.

The rear panel section 40 includes two flap portions 44, 46 extending laterally on opposing sides of the rear panel section 40. The inner-facing surface 16 of the two flaps 44, 46 are covered with a layer of attachment fabric 44*a*, 46*a* in the form of hook-and-loop type fastening members. A complementary layer of the attachment fabric 28 covers a substantial portion of the outer-facing surface 14 of the front panel section 20 so that when the patient assistance device 10 is properly configured on a patient, the two flap portions 44, 46 of the rear panel section 40 can be pulled forward underneath the patient's arms and selectively attached to the outer-facing surface of the front panel section 20. The two flap portions 44, 46 are of sufficient length so as to be adjustable along the lateral width of the complementary layer of the attachment fabric 28 fixably attached to the front panel section 20. Pull tabs 48 may be attached to the distal ends of the two flap portions 44, 46 to provide leverage in pulling the two flap portions 44, 46 away from the complementary layer of the attachment fabric 28 attached to the front panel section 20.

As shown in FIG. 1, when the two flap portions 44, 46 of the rear panel section 40 are properly attached to the outer-facing surface of the front panel section 20, the patient assistance device 10 effectively becomes a vest-type garment designed to completely surround the patient's torso. The fit of the vest-type garment device 10 is easily adjusted by varying the position of the two flap portions 44, 46 on the lateral width of the complementary layer of the attachment fabric 28 attached to the front panel section 20.

The patient assistance device 10 further includes a plurality of integral, reinforced support straps that are firmly attached to the unitary garment member 12. The support straps are generally constructed of a reinforced webbing material that is flexible but stretch resistant. For example, in a preferred embodiment the support straps comprise ballistic nylon webbing. The support straps are attached to the unitary garment member 12 by adhesive bond, reinforced stitching 78 or a combination thereof. The plurality of support straps enhance the structural integrity of the unitary garment member 12 by transferring and distributing a load applied to one support strap to the entire patient assistance device 10.

The plurality of support straps include two laterally spaced shoulder support straps 50, 52 that extend longitudinally from the edge 42 of the rear panel section 42 to the edge 22 of the front panel section 20, and are positioned on the unitary garment member 12 so as to pass on opposing lateral sides of the head opening 32 in the middle panel section 30.

In addition, two back support straps 60, 62 are configured in a criss-cross or crossbuck arrangement across the rear panel section 40. The ends of the back support straps 60, 62 are attached to the two shoulder support straps 50, 52 thereby enhancing the structural rigidity of the rear panel section 40. Similarly, the front panel section 20 includes a lateral support strap 58 that extends between the two shoulder support straps 50, 52 enhancing the structural rigidity of the front panel section 20. Finally, each flap portion 44, 46 of the rear panel section 40 includes a support strap 54, 56 that is laterally spaced from its respective shoulder support strap 50, 52.

The patient assistance device 10 further includes one or more strategically positioned hand holds that are attached to the support straps. The hand holds provide enhanced leverage, which enables a caregiver to more easily assist a patient wearing the device to move from one position to another. The hand holds comprise straps of reinforced webbing material fixably attached to the support straps. The ends of the hand holds may be attached to the support straps by adhesive bond, mechanical bond (e.g., rivets (not shown) or reinforced stitching 78) or a combination thereof. The hand holds may further comprise plastic handles 70 attached to the straps.

The embodiment of the patient assistance device 10 depicted in the Figures includes five hand holds. Matching hand holds 72, 73 are configured on opposing support straps 52, 50 on the front panel section 20. The front hand holds 72, 73 are positioned so that, when the vest 10 is properly configured on a patient, they are situated adjacent to the patient's sternum region. A lateral hand hold 74 attached to the support straps 50, 52, 58 is also provided that spans the patient's sternum region. Two side hand holds 75, 76 having one end attached to its respective shoulder support straps and another end attached to its respective side support strap are also provided. For example, as illustrated in the depicted embodiment, the left side hand hold 76 has one end attached to the left shoulder support strap 50 near the bottom edge 42 of the rear panel section 40 and a second end attached near the top of the left side support strap 54. Similarly, the right side hand hold 75 has one end attached to the right shoulder support strap 52 near the bottom edge 42 of the rear panel section 40 and a second end attached near the top of the right side support strap 56.

The patient assistance device 10 may further include one or more grommets 80, which improve the breathability of the garment member 12, further enhancing the comfort of the patient wearing the assistance device 10. The grommets 80 form an aperture through the patient assistance device 10 that permits air and water vapor to flow more freely from the device's interior to the ambient exterior and vice-versa. In one embodiment, the grommets 80 are constructed from polycarbon resin pellets. In the embodiment depicted in the Figures, one or more grommets 80 are spaced along the support straps of the vest device 10.

Figure 4:
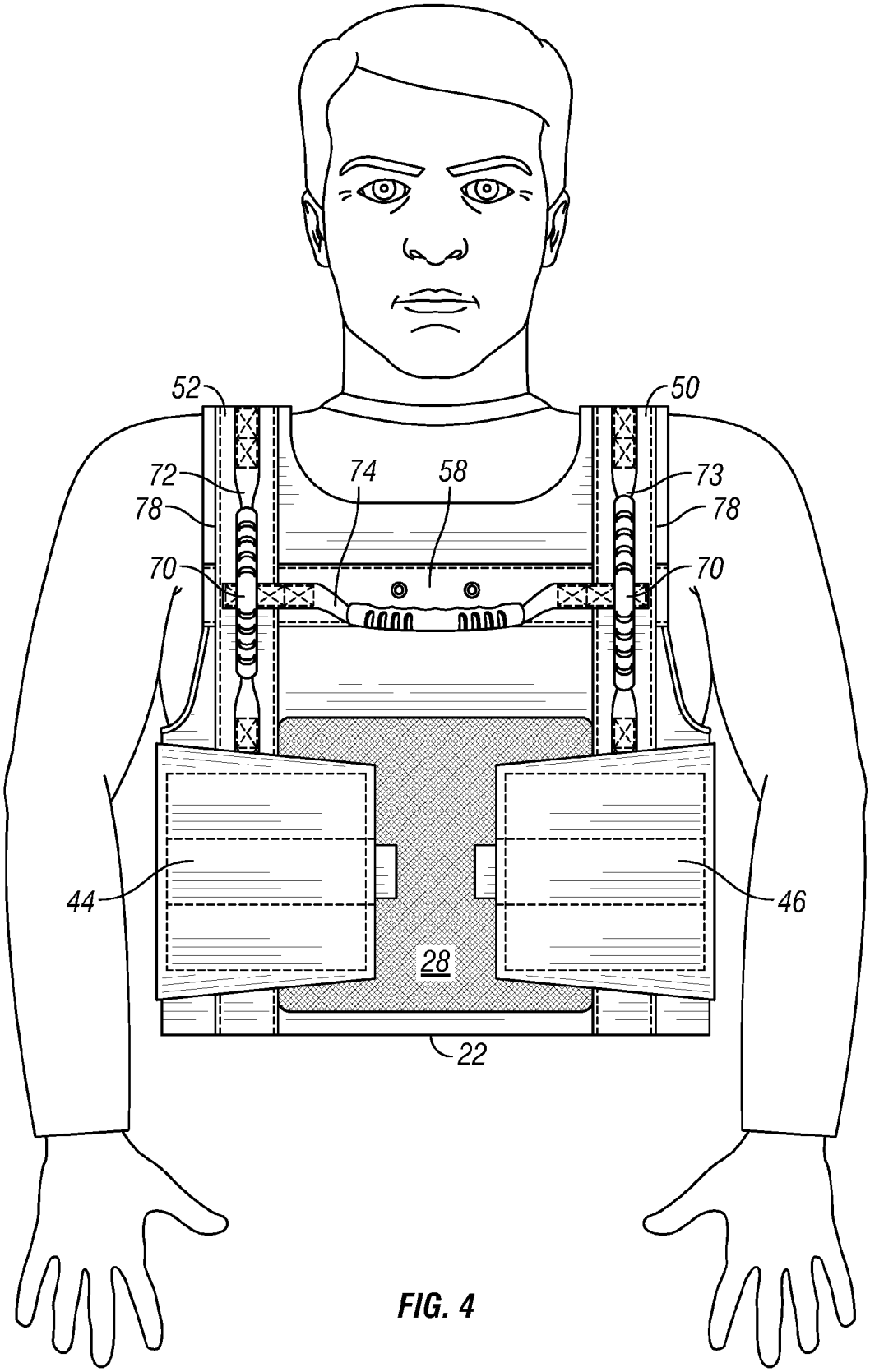
FIG. 4 is a front elevation view of the device shown in FIG. 1 as worn by a patient.
Figure 5:
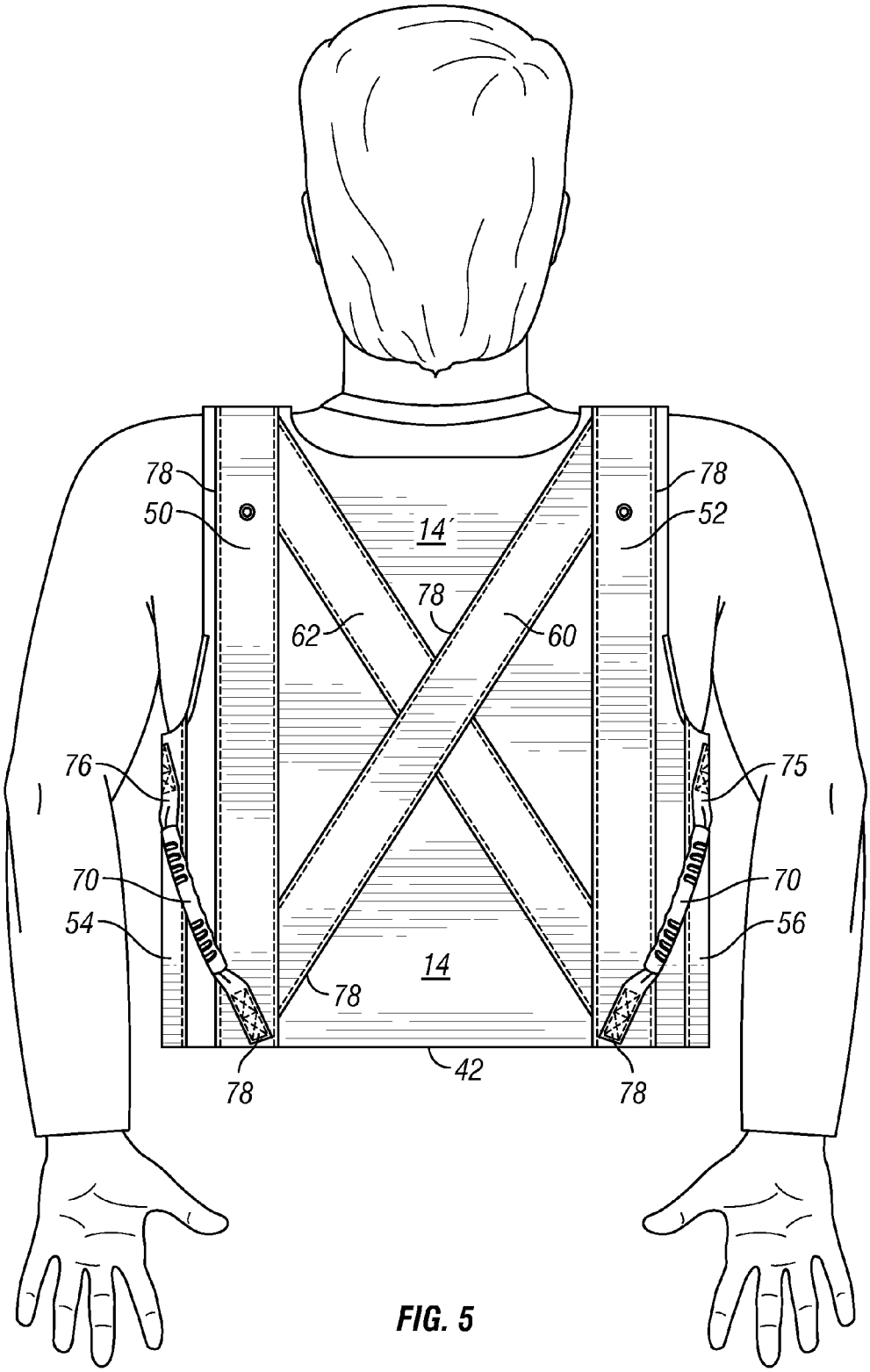
FIG. 5 is a back elevation view of the device shown in FIG. 1 as worn by a patient.
Figure 6:
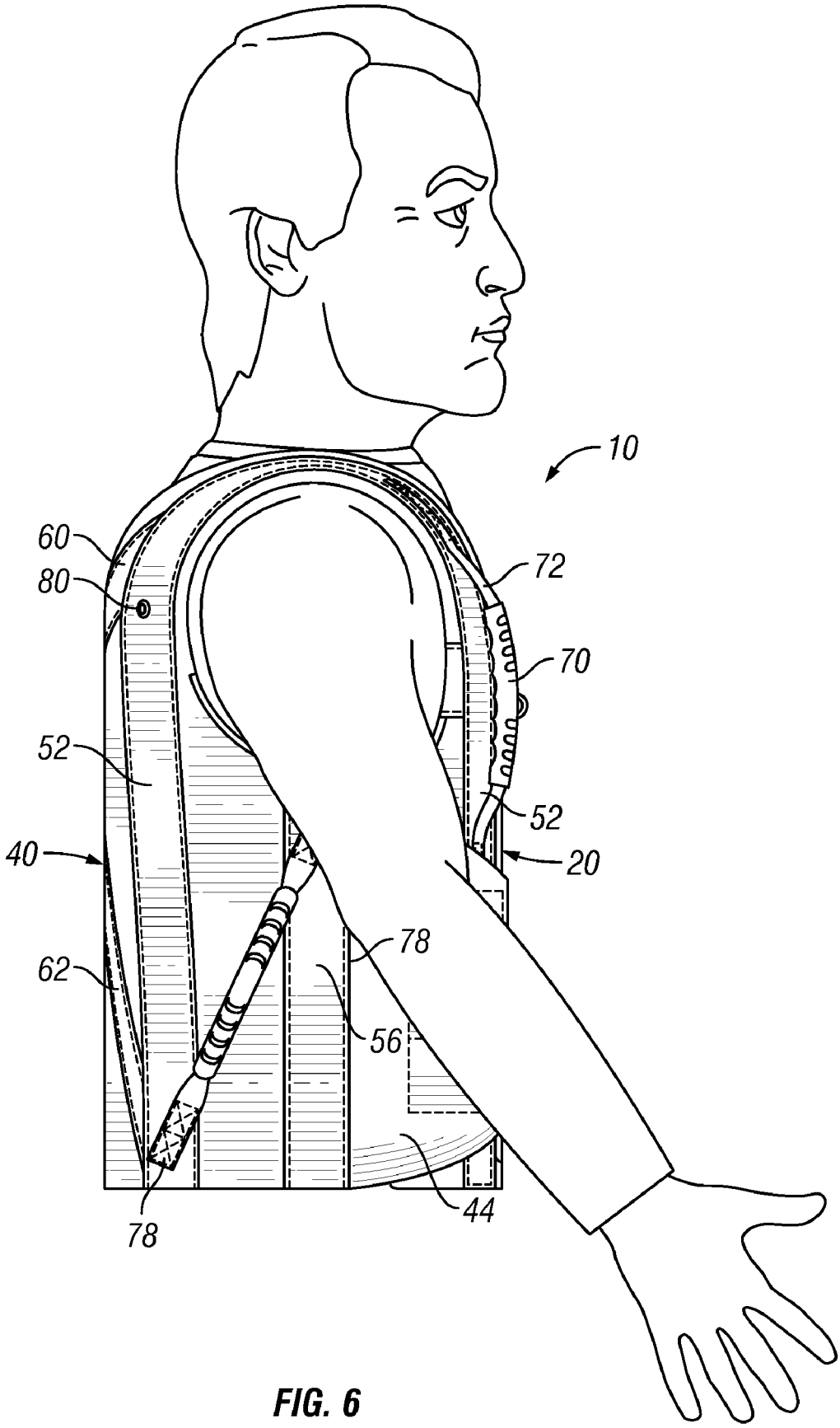
FIG. 6 is a side elevation view of the device shown in FIG. 1 as worn by a patient.

With reference FIGS. 4-6, an embodiment of the patient assistance device 10 is depicted that is properly configured on a patient. Preferably, the patient wears a light fabric undergarment under the patient assistance device 10. The undergarment may also be treated with an anti-microbial agent for added hygienic protection. The patient's head is inserted through the opening 32 so that the central panel section 30 is positioned over the patient's shoulders with the front panel section 20 situated over the patients chest and the rear panel section 40 is situated over the patient's back. As shown in the Figures, when the patient assistance device 10 is properly configured on a patient, the bottom edge 22 of the front panel section 20 is positioned adjacent to the patient's waistline region and the bottom edge 42 of the rear panel section 40 is positioned adjacent to the patient's lower back region.

The two flap portions 44, 46 are then pulled forward and over the wings 24, 26 of the front panel section 20, and securely attached to the attachment fabric 28 on the front panel section 20 by means of the previously disclosed hook-and-loop type attachment fabric 44*a*, 46*a* covering the inner-facing surface 16 of the two flaps 44, 46. When thus attached, the two flap portions 44, 46 form a wide belt around the patient's torso effectively locking the patient assistance device 10 securely in place forming a snug fit with the patient. The front, central and rear panel sections of the unitary garment member 12 thus form a cohesive vest garment that surround the surround the patient's torso.

The plurality of integral, reinforced support straps provide further structural firmness and support. Moreover, when the patient assistance device 10 is transformed into the cohesive vest garment shown in the Figures, the configuration of the individual support straps provide a structural web of mutual support. As shown in the Figures, the shoulder support straps 50, 52 are aligned vertically on the front 20 and rear 40 panel sections. The flap support straps 54, 56 are similarly aligned vertically under the patient's axilla on the side torso or rib cage region. The two back support straps 60, 62 are configured in a criss-cross or crossbuck arrangement across the rear panel section 40. The ends of the back support straps 60, 62 are attached to the two shoulder support straps 50, 52 thereby enhancing the lateral structural rigidity of the rear panel section 40. Similarly, the lateral support strap 58 extending between the two shoulder support straps 50, 52 on the front panel section 20 enhance the lateral structural rigidity of the front panel section 20.

The one or more strategically positioned hand holds, which are attached to the support straps, draw on this structural web to enhance the leverage of the caregiver. Loads applied to the hand holds are transferred to a support strap, which in turn transfers and distributes the load to the other support straps and the unitary garment member 12. For example, as shown in FIGS. 4 and 6, the front hand holds 72, 73 are positioned so that they are situated adjacent to the patient's sternum region. In addition, a lateral hand hold 74 attached to the support straps 50, 52, 58 that spans the patient's sternum region may also be provided. By configuring readily accessible hand holds near the patient's chest area's center of mass the patient assistance device 10 enhances the caregiver's leverage, thereby enabling a caregiver to more easily assist a patient wearing the device to move from one position to another.

As shown in FIGS. 5 and 6, the two side hand holds 75, 76 have one end attached to its respective shoulder support straps and another end attached to its respective side support strap are also provided. For example, as illustrated in the depicted embodiment, the left side hand hold 76 has one end attached to the left shoulder support strap 50 near the bottom edge 42 of the rear panel section 40 and a second end attached near the top of the left side support strap 54. Similarly, the right side hand hold 75 has one end attached to the right shoulder support strap 52 near the bottom edge 42 of the rear panel section 40 and a second end attached near the top of the right side support strap 56. The two side hand holds 75, 76 provide improved leverage in moving a patient both laterally and vertically. For example the side hand holds 75, 76 can be used to assist the patient out of his bed or wheelchair, position him laterally on an MRI table or assist him when floating on his back or stomach in a water aerobics class. Moreover, by configuring the side hand holds 75, 76 so that they are not positioned on the patient's back when in a supine position, the side hand holds 75, 76 provide increased leverage without sacrificing patient comfort.

In addition, the subject patient assistance device 10 is inherently easier for a patient to put on and take off. In addition, it is more easily adjusted for a particular situation. For example, with the patient is in a sitting position, the assistance device 10 is situated over the patient so that the opening 32 is positioned over the patient's head. The assistance device 10 is then lowered over patient's head and draped across the patient's shoulders so that the front panel section 20 is configured in front of the patient's chest region and the rear panel section 40 is configured about the patient's back region. The two flap portions 44, 46 are then pulled forward and attached to the front panel section 20 by means of the previously disclosed hook-and-loop type attachment fabric. Thus, a patient does not have to raise his arms to put the device 10 on. Moreover, the fit of the patient assistance device 10 may be easily adjusted for changing circumstances. For example, just prior to lifting a patient using the subject patient assistance device 10, the two flap portions 44, 46 may be quickly repositioned closer to the each other on the attachment fabric 28 of the front panel section 20 so that the fit of the assistance device 10 is tighter and more secure. Upon completion of the lift or movement, the two flap portions 44, 46 may be quickly released or loosened from the attachment fabric 28 and repositioned to a more relaxed or comfortable fit.

Figure 3:
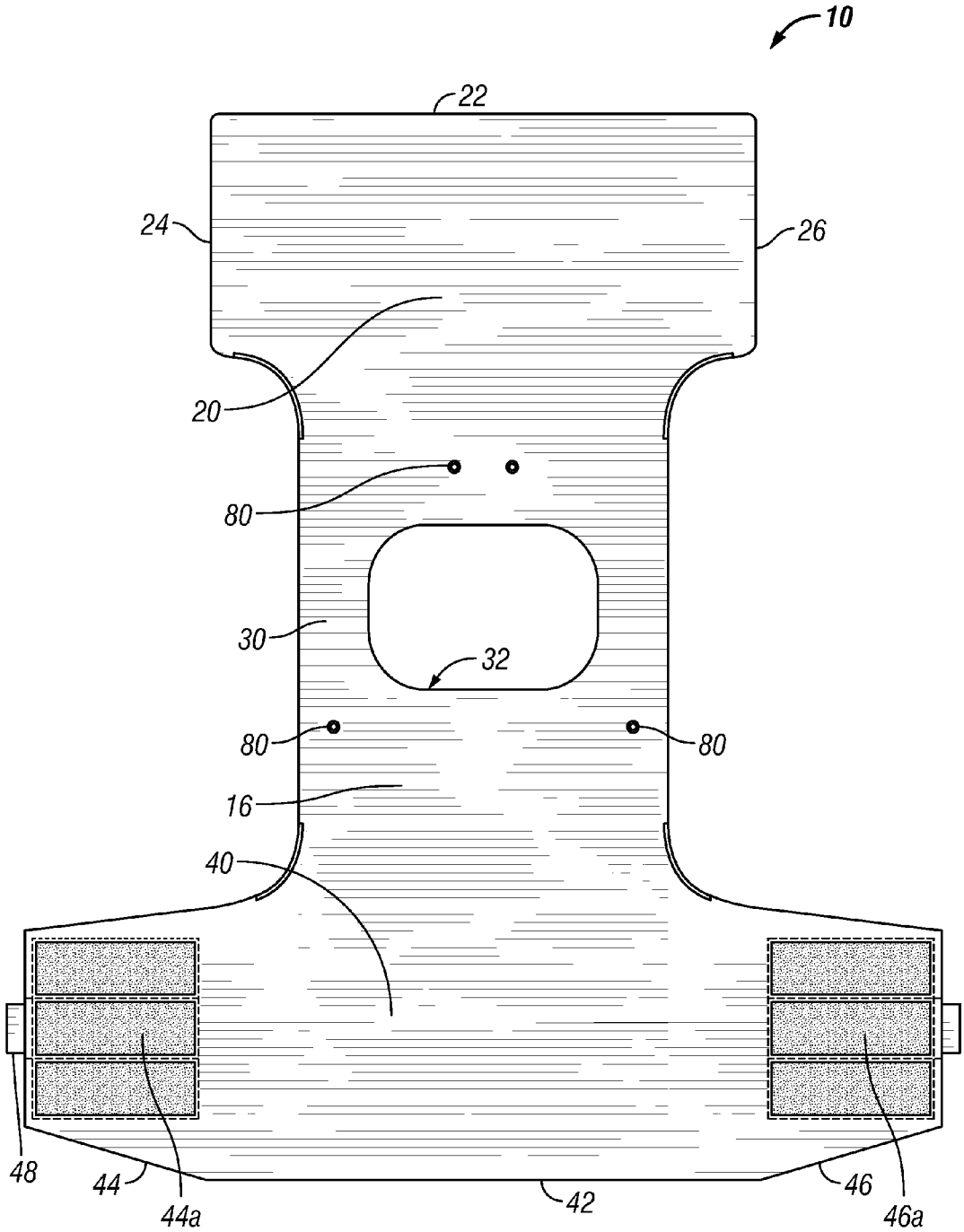
FIG. 3 is a bottom plan view of the device shown in FIG. 1 in a fully opened configuration

Moreover, the subject patient assistance device 10 is just as easy to put on a patient in a supine position. In this case the subject patient assistance device 10 is configured adjacent to the supine patient in a fully open position as shown in FIG. 3. The edge 42 of the rear panel section 40 is generally positioned even with the patient's waist so that the opening 32 in the middle panel section 30 is positioned adjacent with the patient's head. The patient can then be gently lifted while the flatly configured assistance device 10 is slid underneath. The front panel section 20 is then folded over and onto the patient's chest; whereupon the two flap portions 44, 46 are pulled forward and attached to the front panel section 20 as described previously. Once again, the patient does not have to raise his arms to put the device 10 on.

It will now be evident to those skilled in the art that there has been described herein an improved lifting assistance device. The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

Although the invention hereof has been described by way of a preferred embodiment, it will be evident that other adaptations and modifications can be employed without departing from the spirit and scope thereof. For example, while the depicted embodiment shows the multiple support straps attached to the outer-facing surface 14 of the garment member 12, it is within the scope of the invention that the straps may be incorporated into the composite construction of the material forming the garment member 12. The terms and expressions employed herein have been used as terms of description and not of limitation; and thus, there is no intent of excluding equivalents, but on the contrary it is intended to cover any and all equivalents that may be employed without departing from the spirit and scope of the invention.

We claim:

1. A patient assistance device configured to be worn on the upper torso of a patient that provides hand holds by which a care giver may assist a patient in moving from one position to another, comprising:

a unitary garment member having an inner-facing surface and an outer-facing surface, said garment member including a front panel section, a middle panel section and a rear panel section, said front panel section having a layer of attachment fabric attached to said outer-facing surface, said middle panel section having a head opening formed therethrough; said rear panel section having two flap portions extending laterally on opposing sides of said rear panel section, each of said flap portions having a layer of attachment fabric attached to said inner-facing surface, wherein by pulling said flap portions forward and attaching to said front panel section, a cohesive vest garment surrounding the patient's torso is selectively formed;

a plurality of support straps, having a length, fixably attached substantially along the entire length to said unitary garment member, said plurality including a first strap extending longitudinally from an edge of said rear panel section to an edge of said front panel section;

a second strap that extending longitudinally from said edge of said rear panel section to said edge of said front panel section; said first and second straps configured on opposing sides of said head opening;

a third and fourth strap configured in a crossbuck arrangement across said rear panel section and attached to said first and second straps; and a fifth strap attached laterally onto said front panel section, said fifth strap attached to said first and second straps wherein, the plurality of support straps enhance the structural integrity of the unitary garment member by transferring and distributing a load applied to one support strap to the entire patient assistance device.

2. The device of claim 1 wherein said unitary garment comprises a flexible material.

3. The device of claim 2 wherein said unitary garment comprises a neoprene rubber material.

4. The device of claim 3 wherein said neoprene rubber material is treated with an anti-microbial agent.

5. The device of claim 4 wherein said anti-microbial agent forms a covalent bond with said neoprene rubber material.

6. The device of claim 1 wherein said unitary garment comprises multiple layers of a neoprene rubber material bonded together.

7. The device of claim 1 further comprising one or more grommets, said grommets forming an aperture through said device allowing ambient air and water vapor to flow more freely from said inner facing surface to said outer-facing surface.

8. The device of claim 1 wherein said support straps are comprised of a reinforced webbing material that is flexible but stretch resistant.

9. The device of claim 8 wherein said reinforced webbing material comprises ballistic nylon webbing.

10. The device of claim 1 further comprising:

a sixth strap configured on a first of said flap portions and laterally spaced from said first strap; and a seventh strap configured on a second of said flap portions and laterally spaced from said second strap.

11. A patient assistance device for assisting a caregiver in moving a patient from one position to another, comprising:

a unitary garment member having an inner-facing surface and an outer-facing surface, said garment member including a front panel section, a middle panel section and a rear panel section, said front panel section having a layer of attachment fabric attached to said outer-facing surface, said middle panel section having a head opening formed therethrough; said rear panel section having two flap portions extending laterally on opposing sides of said rear panel section, each of said flap portions having a layer of attachment fabric attached to said inner-facing surface, wherein by pulling said flap portions forward and attaching to said front panel section, a cohesive vest garment surrounding the patient's torso is formed;

a plurality of support straps, having a length, fixably attached substantially along the entire length to said unitary garment member, said plurality including a first strap extending longitudinally from an edge of said rear panel section to an edge of said front panel section;

a second strap that extending longitudinally from said edge of said rear panel section to said edge of said front panel section; said first and second straps configured on opposing sides of said head opening;

a third and fourth strap configured in a crossbuck arrangement across said rear panel section and attached to said first and second straps; and a fifth strap attached laterally onto said front panel section, said fifth strap attached to said first and second straps;

a sixth strap configured on a first of said flap portions and laterally spaced from said first strap; and a seventh strap configured on a second of said flap portions and laterally spaced from said second strap;

a plurality of hand holds fixably attached to said unitary garment and said support straps including a first hand hold fixably attached to a portion of said first strap on said front panel section;

a second hand hold fixably attached to a portion of said second strap on said front panel section; and a third hand hold positioned laterally between said first and second strap and having one end fixably attached to said first strap and a second end fixably attached to said second strap wherein, the plurality of support straps enhance the structural integrity of the unitary garment member by transferring and distributing a load applied to one support strap to the entire patient assistance device.

12. The patient assistance device of claim 11, wherein when said device is formed into a cohesive vest garment surrounding the patient's torso said first, second and third hand holds are configured adjacent to patient's sternum.

13. The patient assistance device of claim 11, further comprising:

a fourth hand hold having a first end fixably attached to said first strap and a second end fixably attached to said sixth strap; and a fifth hand hold having a first end fixably attached to said second strap and a second end fixably attached to said seventh strap.

14. The patient assistance device of claim 12, where said hand holds further include plastic handles attached thereto.

15. The patient assistance device of claim 11, wherein said unitary garment comprises a flexible material.

16. The patient assistance device of claim 12, wherein said unitary garment comprises a neoprene rubber material.

17. The patient assistance device of claim 16, wherein said neoprene rubber material is treated with an anti-microbial agent.

18. The patient assistance device of claim 11 further comprising one or more grommets, said grommets forming an aperture through said device allowing ambient air and water vapor to flow more freely from said inner facing surface to said outer-facing surface.

19. The patient assistance device of claim 18 wherein said reinforced webbing material comprises ballistic nylon webbing.

20. The patient assistance device of claim 11, wherein said support straps hand holds are comprised of a reinforced webbing material that is flexible but stretch resistant.

* * * * *